United States Patent [19]

Rose

[11] Patent Number: 4,647,733

[45] Date of Patent: Mar. 3, 1987

[54] ADJUSTABLE RATIO TRANSMISSION SWITCH

[75] Inventor: John F. Rose, Underwood, Minn.

[73] Assignee: Proximity Controls, Inc., Fergus Falls, Minn.

[21] Appl. No.: 760,097

[22] Filed: Jul. 29, 1985

[51] Int. Cl.[4] ..... H01H 15/00

[52] U.S. Cl. ..... 200/33 D; 200/38 E

[58] Field of Search ..... 200/30 R, 30 A, 30 AA, 200/31 R, 31 A, 31 CA, 31 DP, 31 V, 38 E, 153 T, 33 D, 1 B, 18, 16 R

[56] References Cited

U.S. PATENT DOCUMENTS

| | | | |
|---|---|---|---|
| 2,114,469 | 12/1934 | Hirschfeldt | 179/90 |
| 2,558,622 | 6/1951 | Mignocchi et al. | 361/191 |
| 2,761,655 | 9/1956 | Lundén et al. | 165/12 |
| 2,848,569 | 4/1958 | Moss et al. | 200/27 |
| 3,054,038 | 9/1962 | Rast et al. | 200/33 D |
| 4,112,265 | 9/1978 | Crepeau et al. | 200/17 |
| 4,214,133 | 7/1980 | Wolford et al. | 200/31 |

OTHER PUBLICATIONS

Bourns Literature—Helical Screw Drive, as shown on the attached literature, Bourns, Inc., Trimpot Division, 1200 Columbia Ave., Riverside, Calif., 92507, Catalog TR-2 Trimpots and Trimmers, Copyright 1981.

*Primary Examiner*—A. D. Pellinen
*Assistant Examiner*—Morris Ginsburg
*Attorney, Agent, or Firm*—Schroeder & Siegfried

[57] ABSTRACT

A shaft position indicator in which the mechanical position of switch actuation is variable with the control of the switch actuators. The switch actuators are controllable through a series of setable cam operated screws or non-mechanical contacts that intercept the switch actuators as they are moved from one position to another, the movement of the cam operated screws overlapping the travel of the switches during one revolution of a lead screw moving the cam operated screws. The input shaft rotation is field adjustable to accept input rotations from 1 to 25 or more revolutions, resulting in accuation of the switch in output performance.

9 Claims, 5 Drawing Figures

ADJUSTABLE RATIO TRANSMISSION SWITCH

DESCRIPTION

BACKGROUND OF THE INVENTION

This invention relates to a device for indicating the position of a rotary shaft and more particularly to an indicator which may be operably controlled at both its initial and closing positions.

The present invention is particularly applicable to both fluid and flow systems in which it is desirable to monitor the condition of rotary valves, that is, whether they are open or closed, and to also control the opening or closing of successive valves in the flow line as a function of the condition of the preceeding valves. Most typically, electrical switches are mechanically opened or closed in response to the state of the rotary valve. The problem becomes aggravated where a particular gate or slide valve is to be monitored as being opened when in fact, it may still be closed. Some means is necessary to properly determine when the valve is "opened" and when the valve is "closed". With the use of the present switch arrangement, and cam operated screws, the initial and closed conditions of a valve are correctly simulated with such a mechanism regardless of the condition of other valves having a comparable position. That is, several may open at different times and several may close at different times even though they are all considered to be in an "open" or "closed" position.

SUMMARY OF THE INVENTION

The present invention is directed to a lead screw driven transmission block that generally relates to the broad condition of having a valve "opened" or "closed". However, a fine tuned condition may be achieved where the transmission block is moved with a lead screw in which a plurality of threaded bores are formed normal to the direction of movement of the transmission block to actuate a plurality of switches. Cam screws are inserted in threaded bores in the transmission block and may be adjusted at right angles to the direction of movement of the transmission block to properly interpret the position of a valve even though it should be "opened" or "closed". Thus, a fine tuning of the system may be achieved which has not been possible heretofore.

It is therefore a general object of the present invention to provide a transmission block with operable cam screws for operating the switches.

It is still another object of this invention to provide the switches on the transmission block in reverse order for operation from either direction.

It is yet another object of this invention to provide columns of threaded bores in the transmission block into which screws may be inserted.

It is still another object of this invention to provide cam screws to actuate switches or non-mechanical contacts ahead of or behind the actuation position determined by the driven lead screw.

A detailed description of one preferred embodiment of the ADJUSTABLE RATIO TRANSMISSION SWITCH is hereafter described with specific reference being made to the drawings in which.

Figure 5:
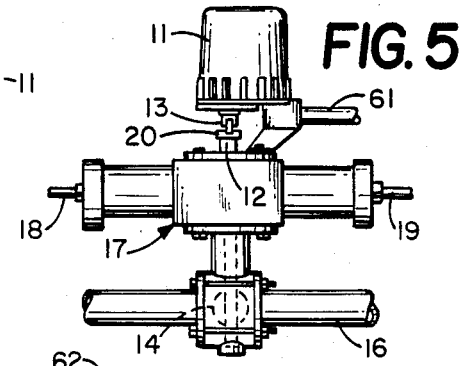
FIG. 5 is a side elevation view of a shaft position indicator connected to sense the position of a valve mechanism.

Reference is first made to FIG. 5 in which there is disclosed a pneumatically actuated rotary valve in which a shaft position indicator 10 includes a generally cylindrical housing or covering 11. The shaft position indicator 10 is coupled to a rotary shaft 12 by means of a spring clip 13. Disposed below rotary shaft 12 is a disk or butter-fly type valve member 14 that controls fluid flow through a conduit 16. A conventional pneumtic actuating device 17 positions butterfly valve 14 and exhaust air may be introduced through a pair of lines 18 and 19 into the pneumatic actuating mechanism 17 to rotate shaft 12 and thereby position valve member 14. Disposed at the upper end of shaft 12, is a coupling member 20 which is adapted to engage spring clip 13.

Housing 11 is secured to a base member 21 by suitable means such as screw threads 22 and a seal is formed between the two with an "O" ring 23.

Figure 1:
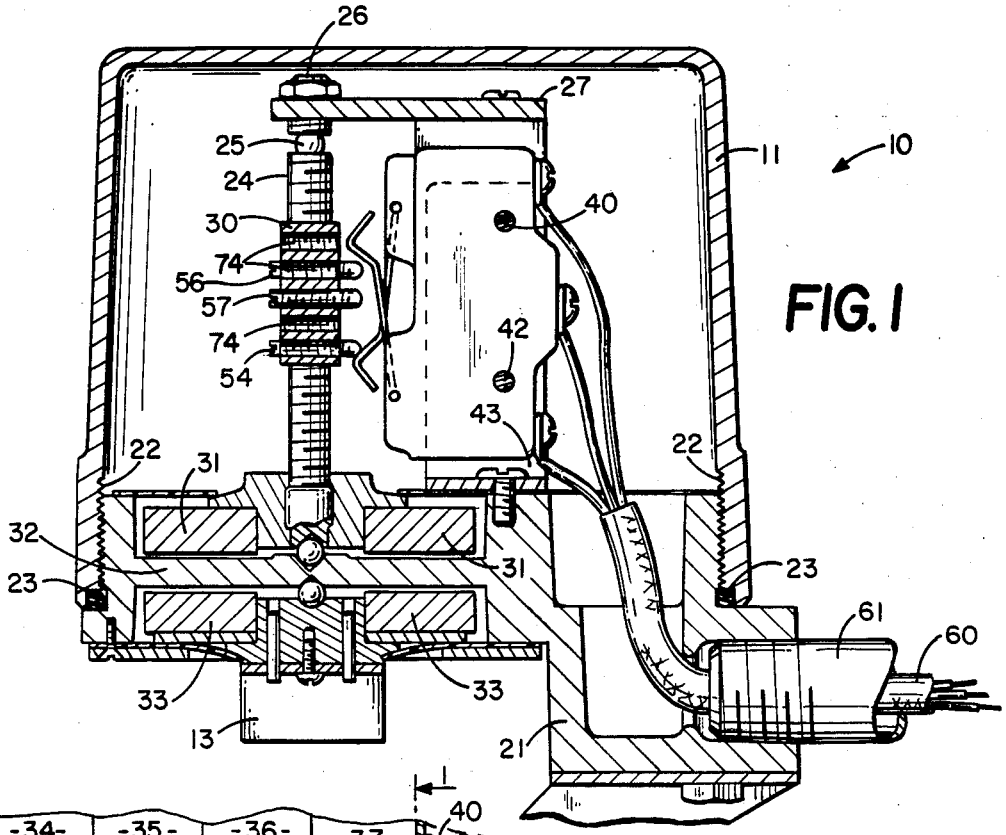
FIG. 1 is a side elevational view of the embodiment of the invention showing actuation of a switch mechanism.
Figure 2:
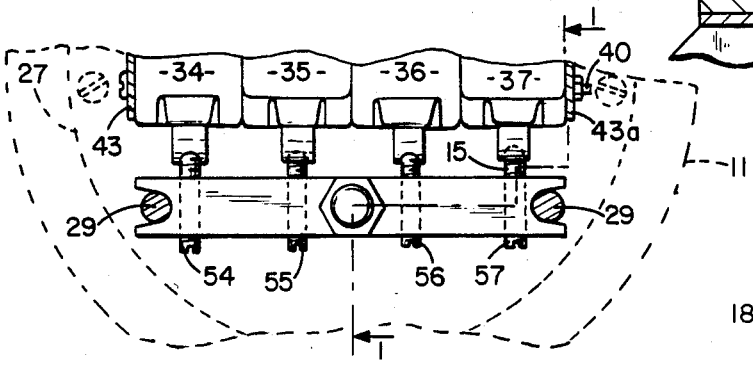
FIG. 2 is a top plan view with the plate broken away to disclose the switch operation.
Figure 4:
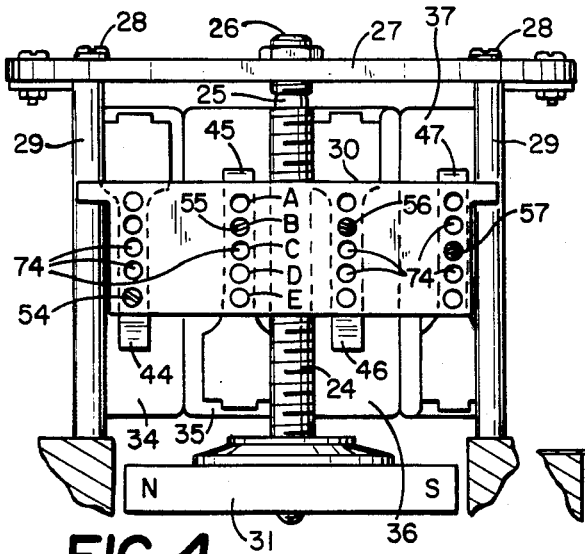
FIG. 4 is a back elevation view of the transmission block and switches.

Reference is generally made to FIGS. 1, 2, and 4 in which a lead screw 24 is vertically oriented and has a ballbearing 25 disposed at the upper end thereof which mates with a bearing journal 26 that is secured in an upper horizontally disposed plate 27. Plate 27 is secured at the upper portions thereof through screws 28, to a pair of posts 29. The lead screw generally uses a ¼-20 machine thread to drive a transmission block 30. That is, transmission block 30 will move upwardly when the lead screw is turned in one direction and will move downwardly when turned in the opposite direction. Using 20 threads per inch, will cause the transmission block to travel 0.050 inches up or down per revolution of the leadscrew. It will be obvious that other thread pitches may be used and that double or triple threads can also be used to increase the travel ratios.

An anular magnet 31 which may have single or multiple north and south poles is secured to the lower end of lead screw 24. A transverse wall 32 separates magnet 31 from a second anular magnet 33 having similar but opposite north and south poles. Thus, rotation of anular magnet 33 will produce rotation of magnet 31 and lead screw 24.

A plurality of threaded bores are formed in transmission block 30 in 4 different columns that are disposed spatially from and in alignment with 4 different switches 34, 35, 36, & 37. It is obvious that different switch mechanisms may be used and different quantities may be assembled so that the different switches may be tripped at appropriate times. Switches 34–37 are secured in place through the use of a pair of machine screws 40 and 42 that extend transversely through a pair of upstanding brackets 43 and **43*a*. Brackets 43 and 43*a* are secured to base member 21** through suitable means such as machine screws.

With switches 34 through 37 facing in opposite directions, that is where the switch followers 44–47 are actuated from opposite directions, different switch motions will be generated so that they will perform with rotations of lead screw 24 as small as one rotation or up to twenty-four rotations. A plurality of set screw cams 54–57 are inserted in appropriate threaded boes 74 to provide the proper actuation of switch followers 44–47. For instance, with set screw 54 in location E, switch 34 will actuate after one clockwise revolution of lead screw 24. If set screw 55 is installed in location B, it will require four turns in the opposite direction before switch 35 will actuate, and if set screw 55 is in location C, it requires seven turns to actuate and if in location D, it requires 10 turns to actuate, and if in location E, it requires 13 turns before switch 35 will actuate. Further ratio changes can be made by moving set screw 54 to location D where 16 counterclockwise turns will be required before switch 44 will actuate; and if set screw 54 is in location C it requires 19 turns to actuate and if in location B, it requires 22 turns to actuate, and if in location A, it requires 25 turns to actuate. The lateral adjustability of set screws 54, 55, 56 and 57 provide additional changes, advancing or retarding the point at which they will actuate.

Using this adjustment in conjunction with the cam position options allows an infinite and fractional rotation ratio to be readily established at the place of installation of the equipment.

The wires or electrical leads 60 from switches 34 through 37 extend downwardly and outwardly through a conduit 61 that is connected to base member 21. Thus, one of the more valuable features of this invention is the capability of attaching the switch to any rotating device having to read out one or more revolutions of a valve member. This device may be readily adjusted to provide control signals at both the initial and closing ends of the rotation and at any intermediate points that are desired, depending upon the number of switches used.

Figure 3:
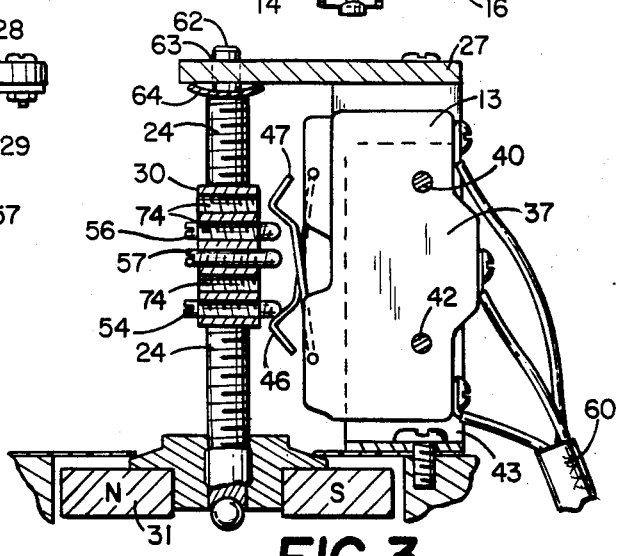
FIG. 3 is a side elevation view of the switches being actuated with an alternate bearing arrangement.

It will also be observed that an alternate form of shaft support is disclosed in FIG. 3. The end of lead screw 24 is formed into a reduced section 62 that passes through a bore 63 formed in plate 27. A wave washer 64 is secured between the end of lead screw 24 and plate 27 to bias the lead screw in an operable position.

It is also a device that may be used with multiple turn potentiometers and/or 4–20 milliamp transmitters or similar control devices, such as non-contacting switches like magnetic reed switches, optical sensors, or Hall Effect devices. While the instant invention is readily adapted for use to provide signals such as lights, buzzers, or audio alarms, to verify valve or gate positions, it may be used to control valve and gate positions through relays, controllers or computers.

In considering this invention, it should be remembered that the present disclosure is illustrative only and the scope of the invention should be determined by the appended claims.

What is claimed is:

1. An adjustable ratio transmission switch mechanism comprising:

(a) a housing having a base member supporting a driving means actuated from outside said housing;

(b) a pair of spatially disposed posts secured to the base member of said housing;

(c) a lead screw mounted in said housing and in operable connection with said driving means, said lead screw rotatable in either direction;

(d) a traveling transmission block having threads that engage said lead screw to move vertically with rotation of the same, said transmission block having guideways that communicate with said pair of posts and having a plurality of threaded bores formed therein normal to said guideways and said lead screw;

(e) a plurality of cam screws threadedly positioned in selected bores of said plurality of threaded bores; and (f) a plurality of switches disposed in cooperating relation with said plurality of cam screws and operable whereby said plurality of switches may be actuated at infinitely adjustable positions between predetermined rotations of said lead screw by varying the threaded position of said cam screws.

2. The invention as set forth in claim 1 including:

(g) a plate transversely secured to the upper ends of said pair of posts to provide support therefor.

3. The invention as set forth in claim 1 including:

(h) a pair of switch support brackers securing said switches against movement while being secured to said base member.

4. The invention as set forth in claim 2 including:

(i) a bearing journal in said plate at the top of said lead screw for supporting the same.

5. The invention as set forth in claim 1 wherein some of said plurality of switches are reversibly disposed with respect to others whereby actuation of switches may occur from both directions.

6. The invention as set forth in claim 1 wherein said plurality of threaded bores include pluralities of bores in columns, each column of which is disposed opposite said plurality of switches.

7. The invention as set forth in claim 1 wherein two cam screw thread turns advances the switch operable point more than the distance of one lead screw turn.

8. The invention as set forth in claim 1 wherein said plurality of cam screws may be retracted or advanced to actuate said plurality of switches ahead of or behind the actuation position determined through rotation of said lead screw.

9. The invention as set forth in claim 1 wherein said plurality of cam screws in conjunction with said traveling transmission block actuates said plurality of switches through said lead screw rotations varying between one to twenty-five or more revolutions, including all fractional input rotations.

* * * * *

UNITED STATES PATENT AND TRADEMARK OFFICE

CERTIFICATE OF CORRECTION

PATENT NO. : 4,647,733

DATED : March 3, 1987

INVENTOR(S) : John F. Rose

It is certified that error appears in the above-identified patent and that said Letters Patent is hereby corrected as shown below:

Column 2, line 68, "boes" should be "bores"

Signed and Sealed this

Fifth Day of January, 1988

*Attest:*

DONALD J. QUIGG

*Attesting Officer*

*Commissioner of Patents and Trademarks*